United States Patent [19]

Erwin

[11] Patent Number: 4,767,239

[45] Date of Patent: Aug. 30, 1988

[54] METHOD AND APPARATUS FOR CONSTRUCTING AN ICE STRUCTURE

[75] Inventor: Richard E. Erwin, Cypress, Tex.

[73] Assignee: Amoco Corporation, Chicago, Ill.

[21] Appl. No.: 1,287

[22] Filed: Jan. 8, 1987

[51] Int. Cl.[4] ..... E02B 17/02

[52] U.S. Cl. ..... 405/217; 37/223; 62/260; 405/195

[58] Field of Search ..... 405/217, 195; 37/219 R; 404/83, 95, 91, 92, 77–79; 299/36, 39, 24; 175/18; 62/259.1, 260

[56] References Cited

U.S. PATENT DOCUMENTS

| | | | |
|---|---|---|---|
| 2,174,250 | 9/1939 | Strand et al. | 299/39 X |
| 3,371,586 | 3/1968 | Nikolaev et al. | 404/91 |
| 3,750,412 | 8/1973 | Fitch et al. | 405/217 |
| 3,842,607 | 10/1974 | Kelseaux et al. | 405/217 |
| 3,986,783 | 10/1976 | Rowley et al. | 404/95 |
| 4,192,630 | 3/1980 | Duthweiller | 405/217 |
| 4,523,879 | 6/1985 | Finucane et al. | 405/217 |
| 4,544,304 | 10/1985 | Fisher | 404/83 X |
| 4,549,364 | 10/1985 | O'Connor | 404/77 X |
| 4,571,117 | 2/1986 | Johnson | 404/77 |

*Primary Examiner*—Dennis L. Taylor

*Attorney, Agent, or Firm*—S. H. Brown; F. E. Hook

[57] ABSTRACT

Method and apparatus for constructing an ice structure. The disclosed ice structures are a road and a grounded ice island which are constructed on a sheet of naturally-occurring ice in an ocean. A vehicle equipped for driving on ice includes thereon a rotatable grinding wheel which may be urged downwardly against the ice over which the vehicle is driven, thereby generating ice chips which are collected on the vehicle. The chips are mixed with water to form a slurry which is pumped through a hose to a portable sprayer through which the slurry is sprayed, thereby forming the ice structure.

3 Claims, 4 Drawing Sheets

METHOD AND APPARATUS FOR CONSTRUCTING AN ICE STRUCTURE

BACKGROUND OF THE INVENTION

1. Field of the Invention

The present invention relates to methods and apparatus for constructing an ice structure and more particularly to such methods and apparatus in which the ice structure is constructed outdoors when the ambient temperature is below freezing.

2. Setting of the Invention

In regions where a naturally-occurring sheet of ice is formed on an ocean surface for a large part of the year, e.g., in arctic regions, it is known to construct an ice island to provide a stable structure from which oil and gas drilling may be conducted. Such islands are constructed by adding ice on top of a sheet of naturally-occurring ice, and some have a great accumulation of ice, thereby forcing the sheet downwardly until it is grounded on the ocean bottom with the added ice extending above the water surface. After the ice island is constructed, a drilling rig and related equipment may be placed on the island for drilling through the ice island and into the earth formations therebeneath.

It is known in the prior art to build an ice island as described above by drilling a hole through a sheet of naturally-occurring ice, pumping water through the hole from the ocean, and spraying the ocean water into the air with partially frozen water landing on the surface of the naturally-occurring ice sheet, thereby adding ice to the sheet in the form of frozen spray. Constructing an ice island by the spraying method as described suffers from several deficiencies. First, spraying of water onto the ice sheet must be periodically halted in order to permit the spray deposited on the ice to freeze. Sometimes spraying is conducted so as to form depressions for capturing drilling fluids and hydrocarbons and the like after drilling commences and to form ridges or berms for shielding the ice island from drifting ice. When the spray technique is used to form such nonlevel features, excessive runoff of spray further slows the rate of construction of the ice island. That is, when spraying onto a sloping surface, some of the spray flows off the surface before it is frozen in place. Regardless of the angle of the surface under construction, it was found that the ambient temperature must be below 0° Fahrenheit to effectively build up the island. In addition, the spray is affected by the prevailing wind. Since the spraying equipment is typically secured in position over a hole drilled through the ice, frequent movement of the spraying equipment to adjust for wind speed and direction may not be economically feasible.

Another technique for constructing an ice island consists of flooding the surface of a naturally-occurring sheet of ice with water, allowing the water to freeze, and then flooding the newly frozen layer. In this manner, the island is built up in layers of ice. Due to the amount of time it takes for the water to freeze after flooding, the water flooding technique for constructing an ice island takes more time than the previously-described spraying technique.

It is also known in the prior art to construct an ice road by collecting snow, raising the temperature of the collected snow, as by adding water, thereby producing slush, and spreading the slush to form a road. In another type of ice road building, ice aggregate is used to form the road and a spray of water is applied to the top of the formed road to bond the upper thickness of the aggregate. These ice road building techniques suffer from deficiencies in that when using the ice aggregate method, multiple passes with a sprayer over the aggregate are necessary to bond the upper layer of aggregate. Moreover, only the upper layer is a solid sheet of ice, thereby reducing the overall strength of the road. Both the slush and the ice aggregate road building methods are not suitable for ice island construction due to the size a typical ice island which can reach a diameter of 600 ft and beyond.

There exists a need for a method and apparatus for constructing an ice structure in a relatively short period of time.

There also exists a need for such a method and apparatus which is suitable for constructing both small and large structures.

There exists yet another need for such a method and apparatus which can be successfully utilized when the ambient temperature is preferably below freezing but above 0° Fahrenheit.

SUMMARY OF THE INVENTION

The instant invention comprises a method and apparatus for constructing an ice structure. The method comprises the steps of chipping ice, mixing the chipped ice only with water to form a slurry, and applying the slurry over a selected area by spraying or flooding, thereby forming the ice structure. The apparatus of the invention performs the steps of the method.

The present invention is particularly useful for constructing an ice island in arctic waters from which oil and gas drilling operations can be conducted.

DETAILED DESCRIPTION OF THE PREFERRED EMBODIMENT OF THE INVENTION

The present invention provides a method and apparatus for constructing an ice structure. The apparatus of the invention includes a vehicle equipped for driving on ice. Ice chipping means operable to generate ice chips from ice along the route over which the vehicle is driven is mounted on the vehicle. Also mounted on the vehicle are means for mixing such ice chips with water to form a slurry for constructing the ice structure.

Figure 1:
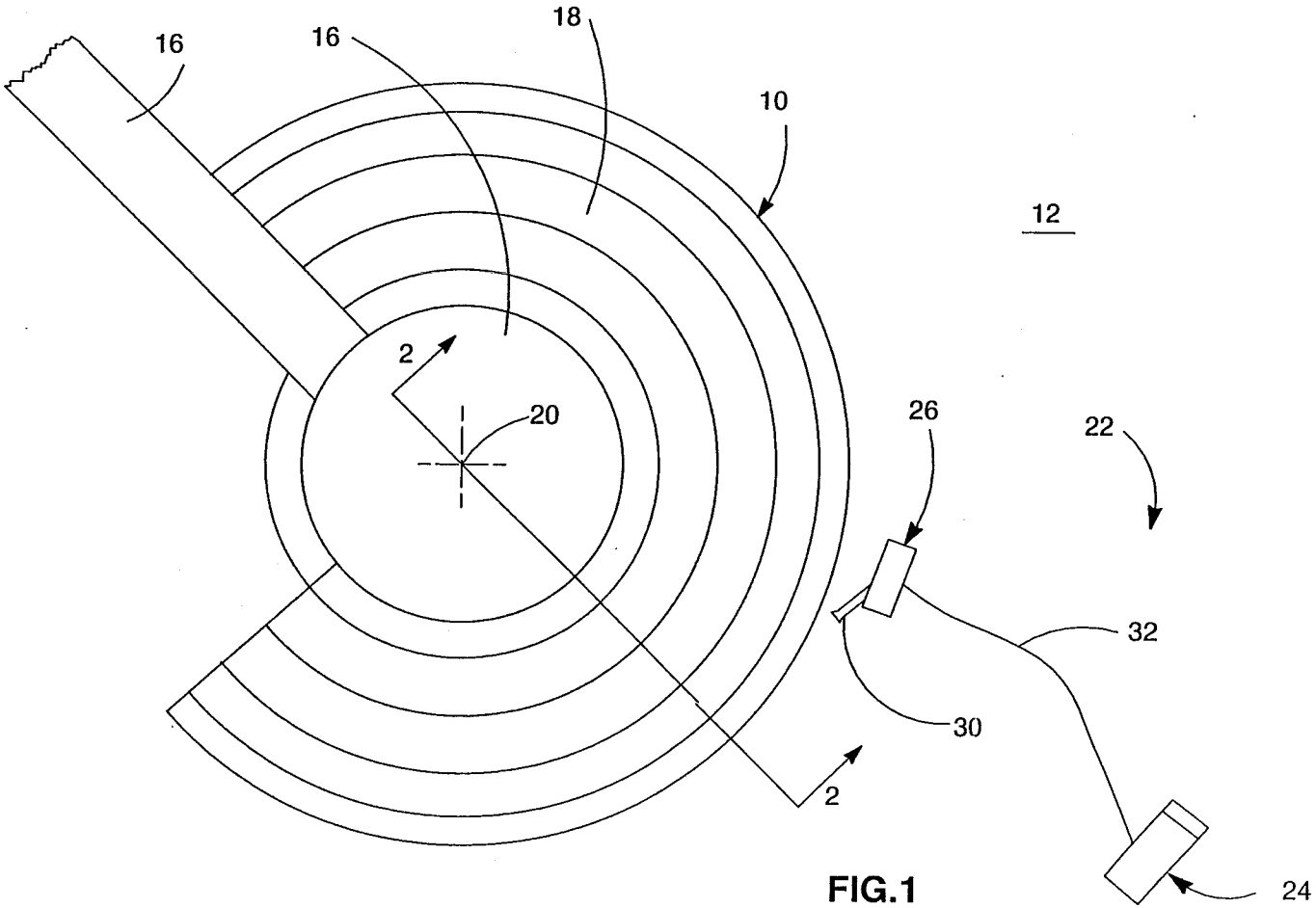
FIG. 1 is a top plan view of a grounded ice island constructed in accordance with the instant invention on a sheet of naturally-occurring ice.
Figure 2:
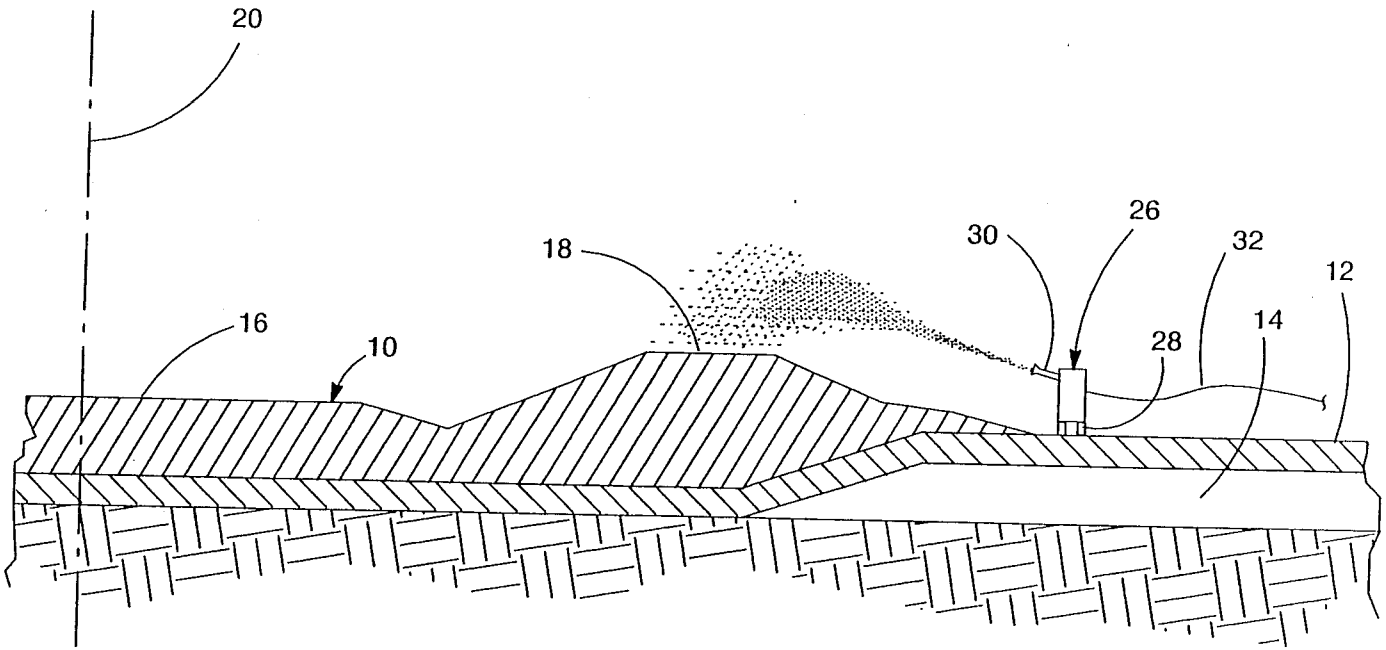
FIG. 2 is an enlarged view taken along line 2—2 in FIG. 1.

Indicated generally at 10 in FIGS. 1 and 2 is an ice structure or ice island constructed in accordance with the method of the instant invention. Ice island 10 is formed on a sheet of naturally-occurring ice 12 over ocean water 14. As shown in FIG. 1, ice sheet 12 completely surrounds ice island 10 which may be constructed many miles from land. An ice road 16, constructed in a manner which will be hereinafter more fully described, connects the ice island with land (not shown) and provides a route for supplying equipment, gear, personnel, etc., to the ice island for conducting drilling operations after the island is completed.

Ice island 10 includes a central drilling pad 16 and a protective berm 18. The berm surrounds approximately ¾ of drilling pad 16 and is oriented in the direction from which sea ice is most likely to approach drilling pad 16. The berm thus provides stability against moving sea ice by virtue of the weight of the berm and in addition tends to deflect ice upwardly rather than laterally absorbing the full force of the moving ice. That portion of drilling pad 16 which is not surrounded by berm 18 provides access to the drilling pad additional to that provided by road 16.

The center of ice island 10 is designated by axes intersection 20 in FIG. 1, such also being identified by a dot-dash axis in FIG. 2.

Indicated generally at 22 in FIG. 1 is apparatus constructed in accordance with the instant invention. Included therein is a vehicle 24 and a sprayer 26, such being mounted on wheels 28 (viewable in FIG. 2) for rolling movement thereon. Sprayer 26 includes a commercially available spray nozzle 30 extending therefrom. A hose 32 connects vehicle 24 with sprayer 26.

Generally speaking, vehicle 24 includes means for chipping ice from ice sheet 12 as the vehicle drives thereover. Vehicle 24 also includes thereon a supply of water which is mixed with the chipped ice to form a slurry that is pumped via a hose 32 to sprayer 26. The chipped ice slurry is sprayed through nozzle 30 onto ice island 10. The slurry forms a layer of ice after it is applied to the existing ice, thereby building ice island 10.

Figure 3:
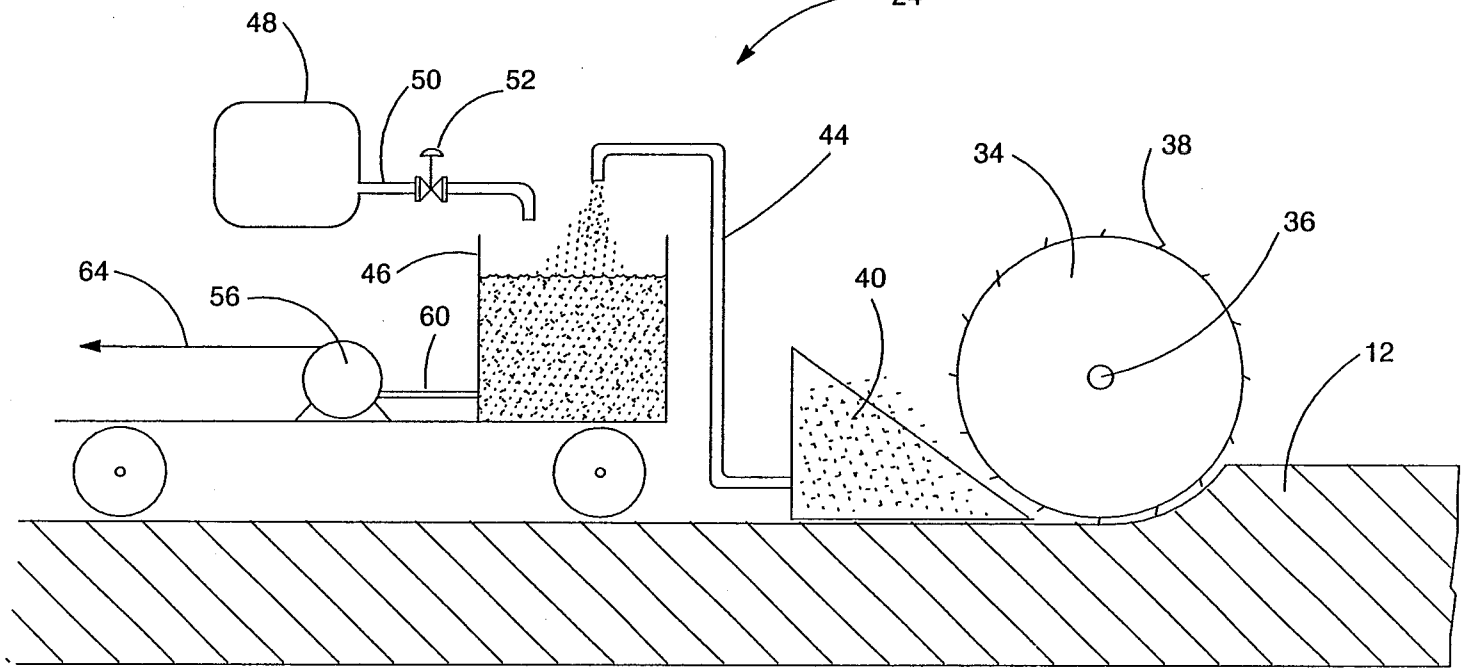
FIG. 3 is a schematic view of apparatus constructed in accordance with the instant invention.
Figure 4:
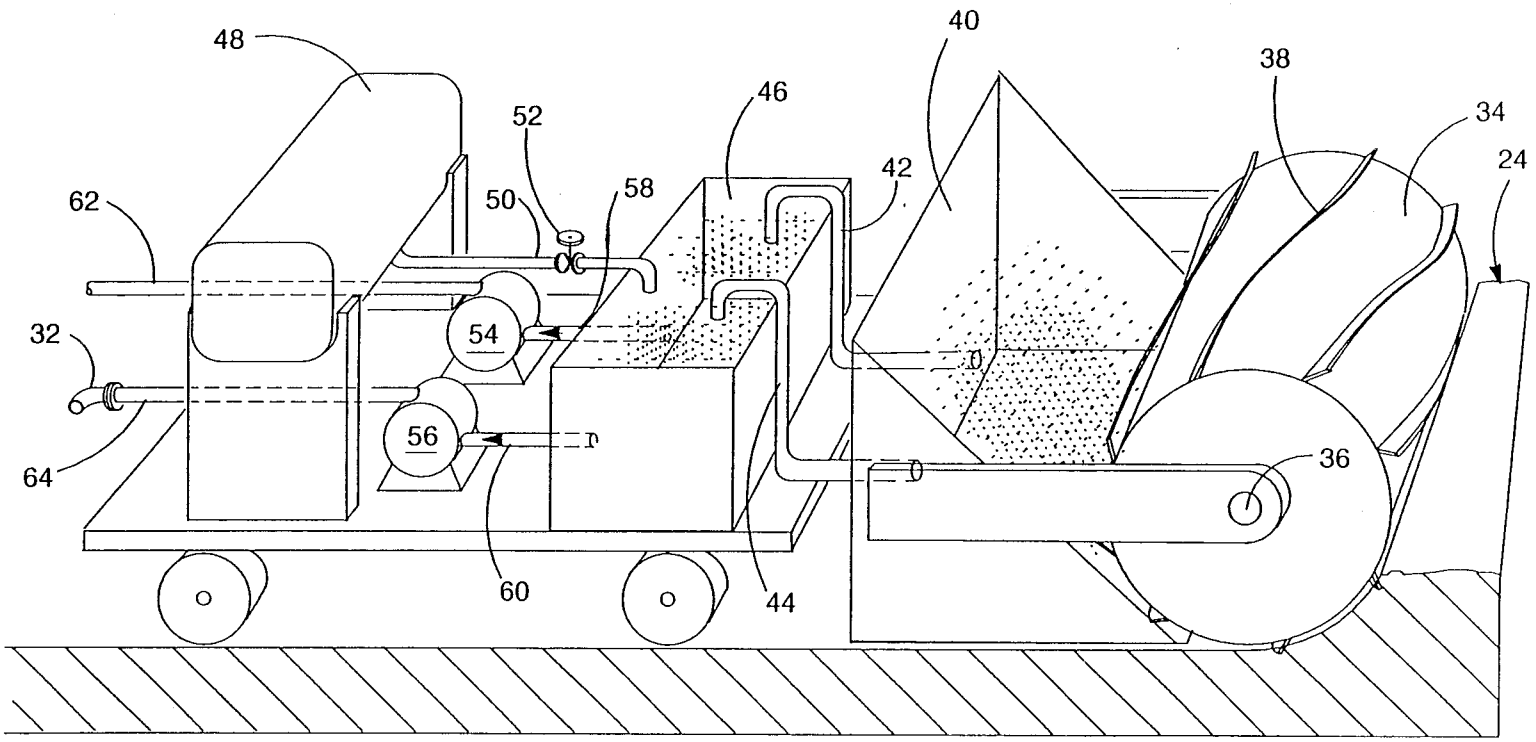
FIG. 4 is a perspective view of apparatus constructed in accordance with the instant invention with a portion thereof being broken away.

For a more detailed consideration of the structure of vehicle 24, attention is directed to FIGS. 3 and 4. Vehicle 24 includes mounted thereon a rotatable grinding wheel 34. The grinding wheel is mounted on an axle 36 for rotation in a clockwise direction as viewed in the drawings. A motor (not visible) is mounted on axle 36 for applying rotational force thereto. Axle 36 is mounted on an assembly (not shown for the sake of clarity) for raising and lowering the axle-motor-grinding wheel combination responsive to an operator-generated command. Thus, the grinding wheel may be lifted upwardly from ice surface 12 as shown in FIG. 4 or may be lowered down onto the surface of the ice for grinding thereagainst. A plurality of chippers 38 are mounted on the grinding wheel for chipping ice from sheet 12 when the wheel, while rotating, is urged thereagainst.

An ice chip collection bin 40 is mounted on vehicle 12 directly behind grinding wheel 34. As can be seen in FIG. 3, bin 40 and wheel 38 are raised and lowered by the previously-mentioned assembly (not shown). Thus, bin 40 is in position for collecting ice chips generated by the action of grinding wheel 34 against ice surface 12.

A pair of vacuum hoses 42, 44 provides communication between bin 40 and a mixing means or tank 46. A pump (not shown) applies a vacuum to the ends of the hoses 42, 44 which are directed into tank 46 thereby causing ice chips collected in bin 40 to be transported through the hoses and into the tank as shown in FIG. 3.

A water tank 48 is mounted on vehicle 24 and includes thereon a heat exchanger (not visible) for preventing water in tank 48 from freezing. A conduit 50 provides communication between tank 48 and mixing tank 46. A valve 52 in conduit 50 permits selectively shutting off the flow of water from the water tank to the mixing tank.

A pair of slurry pumps 54, 56 each has the inlet thereof connected via conduits 58, 60, respectively, to the lower portion of mixing tank 46. The outlet of each pump is connected to a conduit 62, 64, respectively, with hose 32 being fixedly connected to conduit 64. A variation to this arrangement could be where one outlet from each pump is connected through a manifold to a single hose.

In operation, when building ice island 10, sprayer 26 and truck 24 are positioned as shown in FIG. 1. As the truck drives over ice sheet 12, grinding wheel 34 is lowered against the ice sheet while rotating, as shown in FIG. 3, thereby generating ice chips which are collected in bin 40. Vacuum hoses 42, 44 draw ice chips from the bin and deposit them in mixing tank 46. At the same time, water from water tank 48 is provided to mixing tank 46 via conduit 50, thereby creating a slurry, i.e., a mixture of ice chips and water, in the tank. Pump 56 pumps the slurry from the tank to sprayer 26 through hose 32. The hose is connected to nozzle 30 which *sprays* the slurry into the air, as shown in FIG. 2, and deposits the same on the ice island, thereby building up the ice structure. When the water is mixed with the ice chips in tank 46 to form the slurry, the water is cooled by the ice chips. When the slurry is sprayed into the air via nozzle 30, the water is further cooled, thus enabling the slurry mixture to freeze solid to the ice, upon which it lands in a very short time.

Dependent upon wind conditions and the location upon which the slurry is to be deposited to construct pad 16 and berm 18, sprayer 26 may be moved about on wheels 28 in order to optimize the deposit of slurry on the ice island. Another hose (not shown) may be connected to conduit 62 so that two sprayers may be used to spray slurry onto the ice island, or onto another structure, with slurry supplied from vehicle 24.

In operation, when vehicle 24 and sprayer 26 are used to construct a road, like road 16, the vehicle is driven over ice 12 adjacent road 16, thereby generating slurry, as shown in FIG. 3, which is provided to sprayer 26 for spraying the same onto the surface over which the road is to be made. Sprayer 26 may be moved as necessary on ice sheet 12 adjacent the surface on which the road is formed.

When constructing ice island 10, areas on the ice sheet from which the ice has been ground can be flooded while ice is being generated from other portions of the ice sheet, thereby renewing the available ice near the ice island in order to keep the distance between the vehicle and the sprayer at a minimum.

It is also possible to use a conventional water spraying technique to construct ice pad 16 while berm 18 is constructed in accordance with the method of the instant invention.

While the present discussion has been directed to spraying the slurry, another variation is to supply the slurry via a hose directly onto the surface of the ice sheet. Because the slurry of the present invention has a lower water temperature, it will freeze more quickly than any other previous flooding technique. Further, the ice island grinding and pumping plant can be located onshore with a long flexible or fixed pipeline used to provide the slurry to the island site.

The instant embodiments of the method and apparatus disclosed herein may be added to or altered without departing from the spirit of the invention which is defined in the following claims.

What is claimed is:

1. A method for constructing an elevated ice structure formed on a sheet of naturally-occurring ice, comprising:

driving a vehicle on the sheet of ice;

lowering a grinding wheel mounted to the vehicle onto the sheet of naturally-occurring ice;

collecting ice chips which are generated by the action of the wheel on the ice, such ice chips being collected on the vehicle;

mixing the collected ice chips with water to form a slurry of solid ice particles and liquid water, such slurry being collected on the vehicle; and spraying the slurry from the vehicle onto the surface of the sheet of naturally-occurring ice to construct an elevated ice structure.

2. The method of claim 1 wherein the elevated ice structure is a drilling pad.

3. The method of claim 1 wherein the elevated ice structure is a roadway.

* * * * *